United States Patent [19]

Roeder

[11] Patent Number: 4,664,186

[45] Date of Patent: May 12, 1987

[54] DOWNHOLD HYDRAULIC ACTUATED PUMP

[76] Inventor: George K. Roeder, P.O. Box 4335, Odessa, Tex. 79760

[21] Appl. No.: 712,888

[22] Filed: Mar. 18, 1985

[51] Int. Cl.[4] ..... F04B 17/00

[52] U.S. Cl. ..... 166/68.5; 166/106; 417/404

[58] Field of Search ..... 417/404, 403, 525, 526, 417/527; 166/68, 105, 106

[56] References Cited

U.S. PATENT DOCUMENTS

| | | | |
|---|---|---|---|
| 3,182,598 | 5/1965 | McArthur et al. | 417/404 |
| 4,032,266 | 6/1977 | Roeder | 417/571 |
| 4,084,923 | 4/1978 | Roeder | 412/404 |
| 4,406,598 | 9/1983 | Walling | 417/404 |
| 4,477,234 | 10/1984 | Roeder | 417/393 |
| 4,492,537 | 1/1985 | Awerkamp | 417/404 |
| 4,541,783 | 9/1985 | Walling | 417/404 |

FOREIGN PATENT DOCUMENTS

| | | | |
|---|---|---|---|
| 140835 | 4/1951 | Australia | 417/404 |

*Primary Examiner*—Stephen J. Novosad
*Assistant Examiner*—William P. Neuder
*Attorney, Agent, or Firm*—Marcus L. Bates

[57] ABSTRACT

A downhole hydraulically actuated pump has a large diameter power piston and a large diameter production pistion. A traveling valve assembly is located in the power piston and in the production piston, while fluid flow occurs through a hollow connecting rod, thereby providing a downhole pump with a maximum diameter piston assembly at the engine and production ends. A discharge guide conducts spent power fluid from the interior of the hollow connecting rod. Flow of production fluid to the traveling valve assembly of the production piston is provided through a hollow connecting rod extension. In one form of the invention, spent power fluid to which treatment fluid has been added is discharged at the bottom end of the pump assembly, thereby enabling chemical treatment to be carried out at the bottom of the wellbore.

17 Claims, 14 Drawing Figures

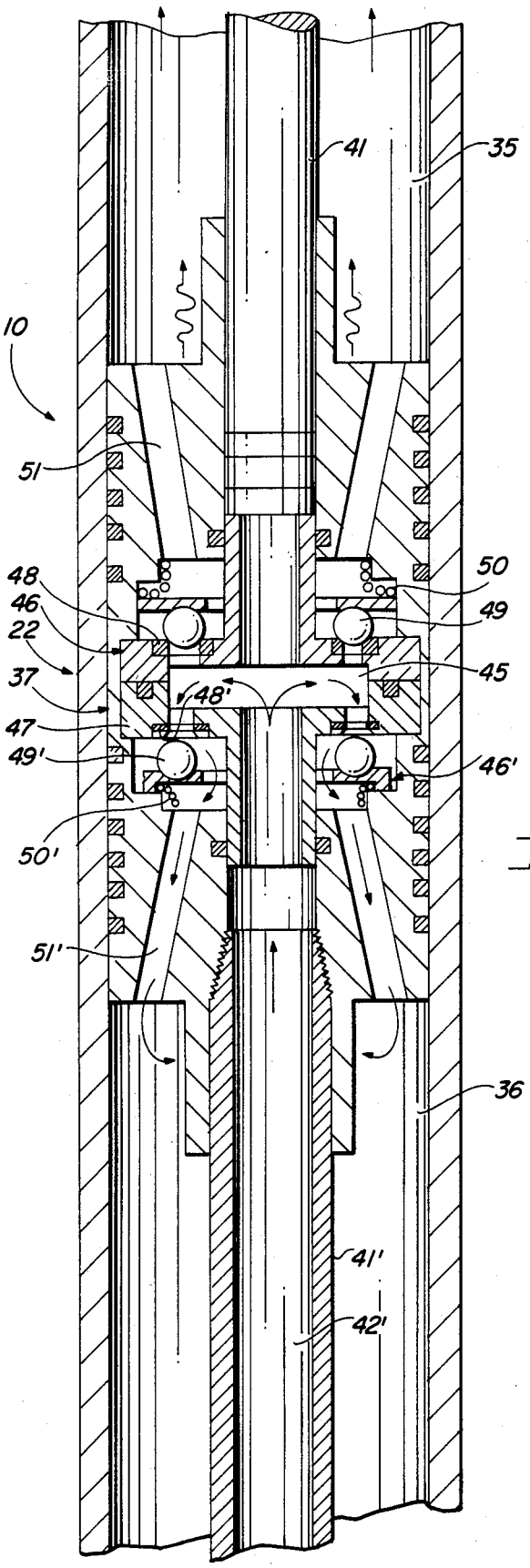
FIG. 4
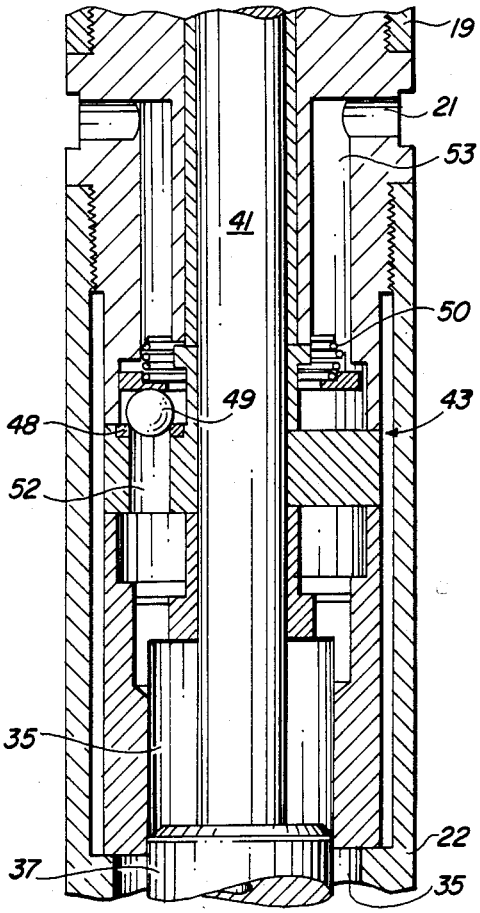
FIG. 5
FIG. 6
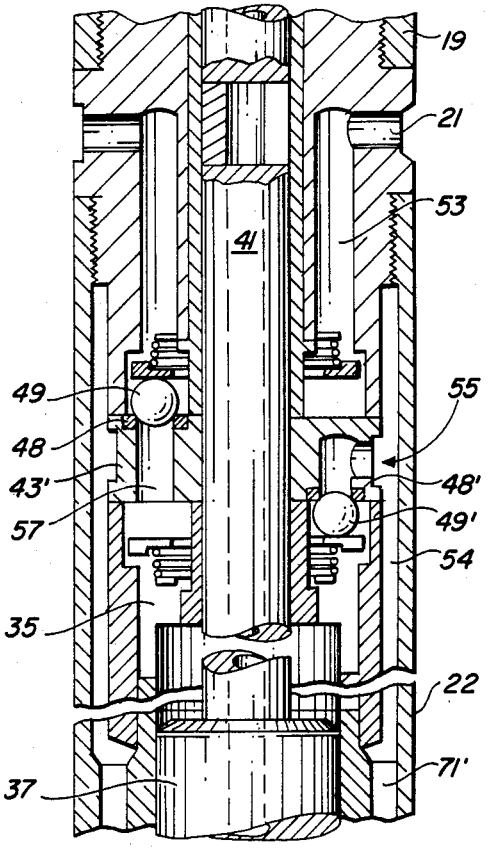

DOWNHOLD HYDRAULIC ACTUATED PUMP

BACKGROUND OF THE INVENTION

Artificially lifting fluid from deep wellbores requires a very carefully designed system, or otherwise the cost of production can exceed the value of the produced fluid. Extremely deep wells require that the borehole be of very small diameter, thereby necessitating the use of a pumping means of a small diameter, so that the pump can be accommodated by the slim hole.

Downhole hydraulically actuated pumps eliminate the necessity for pumpjacks, sucker rod strings, and electrical wires, all of which contribute to reduction in production costs. It is desirable to provide a downhole pump with as large a diameter engine piston and pump piston as possible so that each stroke of the pump apparatus produces a maximum quantity of fluid. All hydraulically actuated downhole pumps must have a housing which forms a working chamber for the engine piston and the production piston, and the interior of the housing represents the maximum diameter any downhole pump can enjoy. In the past, most downhole pumps require fluid passageways leading to and from various expansion chambers of the pump, and this expedient greatly reduces the size of the engine and pump pistons. The present invention provides improvements in downhole pumps having a maximum diameter engine piston and pump piston.

In one form of the present invention, there is provided apparatus and method by which the bottom of the wellbore can be chemically treated by utilizing spent power fluid that previously was admixed with treatment chemical.

In another form of the invention, formation fluid flows into the lower end of the pump, up through a hollow connecting rod extension, into the production piston, and through a pair of intake valves located within the production piston, thereby providing the production end of the pump with a formation fluid inlet and a set of intake valves all located within the reciprocating production piston.

SUMMARY OF THE INVENTION

A hydraulically actuated downhole pump has an engine end and pump end connected together by a connecting rod. The engine and production pistons can be made the largest possible diameter for a specific size outer barrel.

The large diameter engine piston is achieved by incorporating the engine valve assembly within the engine piston, with power fluid flowing to the traveling valve assembly by means of an upper hollow connecting rod extension; and, spent power fluid flowing from the traveling valve assembly by means of a passageway formed through the connecting rod.

In one form of the invention, the spent power fluid flows through the hollow rod, through a reciprocating discharge guide means, through a guide chamber, and out of the pump assembly.

In another form of the invention, the spent power fluid flows through the connecting rod, through the pump piston, through a lower hollow connecting rod extension, and to the bottom of the pump assembly. Treatment fluid admixed with the power fluid at the surface pump enables the wellbore to be chemically treated.

In another form of the invention, a production intake valve assembly is incorporated within the pump piston. Formation fluid flows through a lower connecting rod extension, to the traveling production intake valve assembly, and into the working chambers of the production end, thereby enabling the pump piston to be of the maximum diameter. Produced fluid is exhausted through a pair of production outlet valves and out of the pump assembly.

A primary object of the present invention is the provision of a hydraulically actuated downhole pump assembly having an engine and pump piston of the largest possible diameter for a specific size outer barrel.

Another object of the invention is the provision of a hydraulically actuated pump assembly having a traveling valve located in the engine piston and in the production piston with fluid flowing to and from the engine through a hollow connecting rod, and fluid flowing to the pump through a hollow rod extension.

A further object of this invention is the provision of a hydraulically actuated pump assembly having a discharge guide means between the engine and pump ends for discharging spent power fluid from the engine in a novel manner.

A still further object of this invention is the provision of method of chemically treating a lower end of a wellbore by admixing treatment fluid with the power oil supply for a hydraulically actuated downhole pump assembly, and exhausting spent power oil from the bottom of the pump assembly, where the spent power oil comingles with the produced fluid and thereby exposes the lower wellbore to the treatment fluid.

Another and still further object of the present invention is the provision of a new downhole pump having a discharge guide means reciprocatingly received within a spent power fluid discharge chamber which enables discharge of spent power oil through a connecting rod without reducing the structural integrity of the rod, and at the same time maintaining the rod axially aligned respective to the pump.

A further object of this invention is the provision of a new combination comprising a downhole hydraulically actuated pump assembly which takes on several different forms and achieves several new and unexpected results in the pumping art.

An additional object of this invention is the provision of a hydraulically actuated pump assembly of either the free or fixed type which can be used in a slim hole, and which has engine and production pistons of the largest possible diameter respective to the diameter of the wellbore.

These and various other objects and advantages of the invention will become readily apparent to those skilled in the art upon reading the following detailed description and claims and by referring to the accompanying drawings.

The above objects are attained in accordance with the present invention by the provision of a method for use with apparatus fabricated in a manner substantially as described in the above abstract and summary.

BRIEF DESCRIPTION OF THE DRAWINGS

FIG. 4 is an enlarged, detailed, fragmentary, longitudinal, cross-sectional view of part of the apparatus disclosed in the foregoing figures;

FIGS. 5 and 6 are enlarged, detailed, cross-sectional views of part of the apparatus disclosed in some of the foregoing figures;

DETAILED DESCRIPTION OF THE PREFERRED EMBODIMENTS

Figure 1:
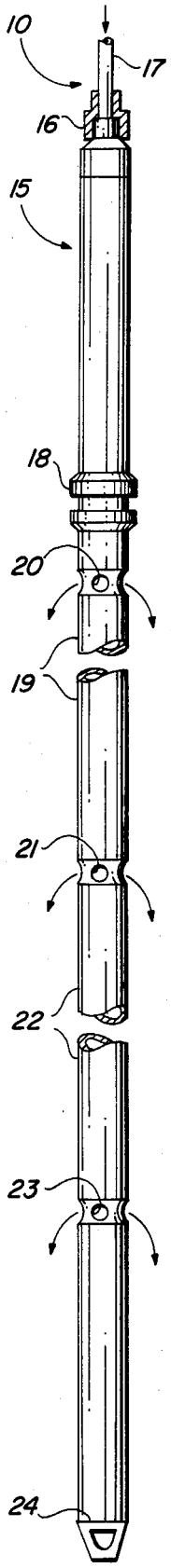
FIG. 1 is a side elevational view of a downhole hydraulically actuated pump made in accordance with the present invention.
Figure 2:
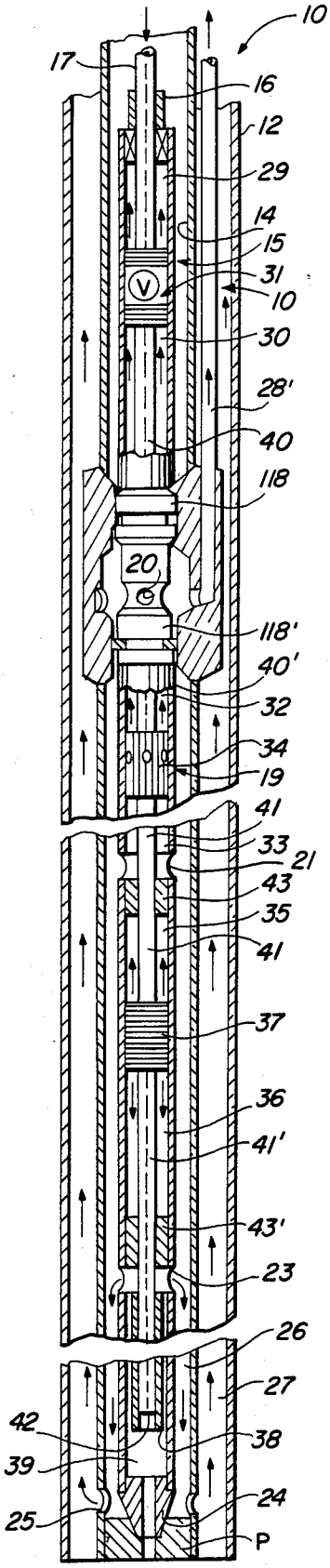
FIG. 2 is a part diagrammatical, part schematical, part cross-sectional, longitudinal view of a wellbore having a pump and related apparatus located therewithin.
Figure 3:
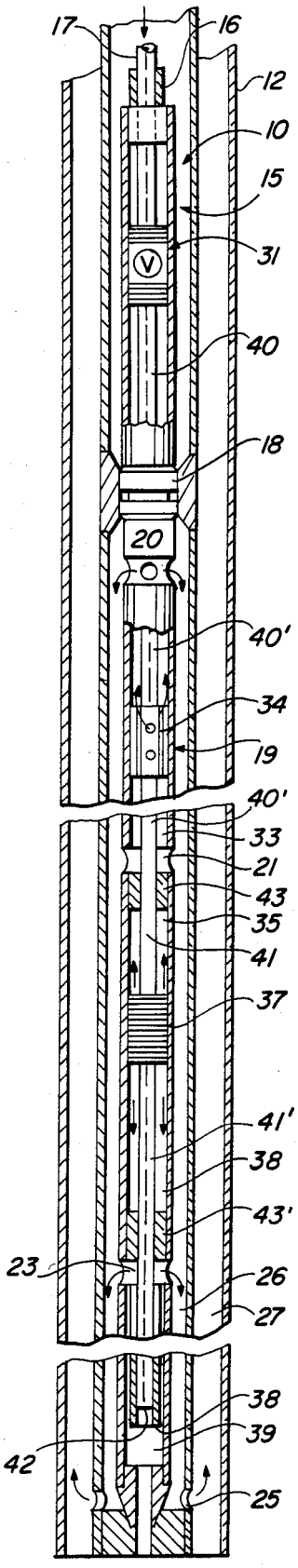
FIG. 3 is a longitudinal, part cross-sectional view of another borehole having a pump located therewithin in accordance with the present invention.

In the figures of the drawings, and in particular FIGS. 1-3, there is disclosed a downhole hydraulically actuated pump 10 made in accordance with the present invention. As seen in FIGS. 2 and 3, the pump of FIG. 1 can be located downhole in a cased borehole 12 within which there is disposed a production tubing 14. The pump 10 has an outer barrel in the form of a circumferentially extending housing 15. Within the housing 15, there is located an engine 16 having a power fluid inlet 17 located at the upper extremity thereof.

A seal assembly 18 separates the engine end 16 from a power discharge tube 19, the details of which will be more fully discussed later on in this disclosure. The power discharge tube has a spent power oil outlet port 20 located below the seal assembly 18 and above a production outlet 21. The pump assembly has a production end 22 located between production outlet ports 21 and 23. Numeral 24 indicates the lower or suction end of the pump assembly of FIGS. 1-3.

In FIG. 2, together with other figures of the drawings, the seal assembly is comprised of spaced seals 118, 118′ received within a suitable cavity which isolates the various flow paths to and from the pump assembly in a manner whereby a closed power flui system is achieved by the illustrated combination. A produced fluid outlet 25 is located adjacent to a packer P and provides a flow path by which produced fluid from production outlet ports 21, 23 flows down the annulus 26, through the outlet ports 25, back up through the casing annulus 27, and to the surface of the ground. Spent power oil return string 28 communicates with the cavity and returns the spent power fluid to the surface pump so that it can be recycled back down the tubing string and into the inlet end 17 of the pump.

The engine end 16 has a working chamber divided into upper engine chamber 29 and a lower engine chamber 30 by the reciprocating engine piston 31. The power discharge tube 19 is divided into upper and lower annular chambers, 32 and 33, by the splined discharge guide 34 which discharges spent power fluid into the chambers 32 and 33. The chambers 32 and 33 are in communication with one another by means of the illustrated spline slotted discharge guide. The upper chamber 32 is in communication with the spent power fluid outlet 20, which in turn is in communication with the spent power oil return string 28 (not part of the pump).

The production end 22, located between production discharge ports 21 and 23, includes a working chamber which is divided into an upper chamber 35 and a lower chamber 36 by means of the production plunger 37. The production plunger 37 includes two traveling formation fluid inlet valves therewithin, the details of which are more fully set forth later on herein. A cylindrical intake pipe 38 is supported in the illustrated manner of FIGS. 2 and 3, with the free end thereof being in communication with a formation fluid intake chamber 39.

The connecting rod 41 located between the discharge guide and production plunger preferably is solid. A connecting rod extension 41′ located between the production plunger 37 and the suction or free terminal end 42 is hollow. Formation fluid entering chamber 39 is available at the suction end of the intake pipe 38 and flows into the lowermost end 42 of the lower rod extension 41′, up through the hollow connecting rod extension 41′, and to the traveling intake valves mounted within the production plunger 37.

Production exhaust valves 43, 43′, located at the upper and lower ends of the production end, are connected to the produced fluid outlets 21 and 23 where the fluid is conducted down through the tubing annulus 26. The details of the exhaust valves are more fully set forth later on herein.

Looking now to the details of the production plunger 37 disclosed in FIG. 4, the plunger 37 is slidably received within the outer housing of the production end 22. The housing has an axial passageway within which the piston is reciprocatingly received, and divides the housing into an upper production chamber 35 and a lower production chamber 36. The plunger 37 has a common interior chamber 45 arranged in communication with formation fluid contained within the chamber 39 by means of the passageway 42′ formed through the lower rod extension 41′. Production intake valve assemblies 46 and 47 are arranged in the illustrated confronting manner of FIG. 4, and include the illustrated valve seats 48, 48′ against which a plurality of balls 49, 49′ are seated. Springs 50, 50′ urge the balls into seated relationship respective to the valve assemblies. Fluid flows from the common intake chamber 45, through the seats 48 and 48′, and through the passageways 51 and 51′ as the engine piston reciprocates the production plunger 37. Further details of the valves 46 and 47 can be found in my U.S. Pat. No. 4,032,266.

FIG. 5 illustrates one form of an exhaust valve 43, which can be used in conjunction with the embodiment of the invention seen disclosed in FIGS. 2 and 3. The valve 43 is similar in construction to the production valves 46 and 46′, and control the flow of produced fluid from production chambers 35 and 36. The valve 43 of FIG. 5 includes the valve seat, ball, and spring assembly previously discussed in conjunction with the valve assembly set forth in FIG. 4.

Figure 7:
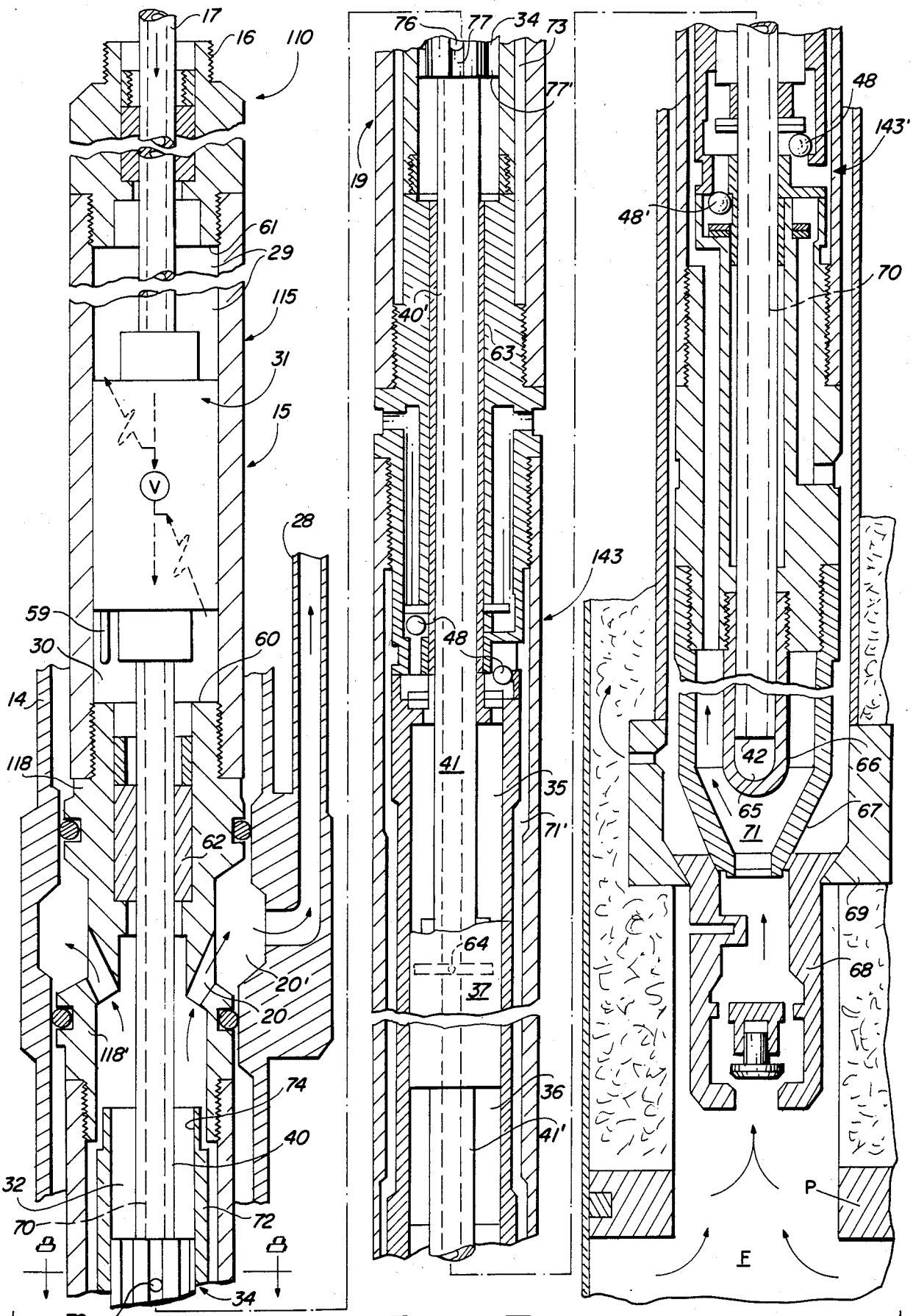
FIG. 7 is a longitudinal, part cross-sectional view of another embodiment of a downhole pump made in accordance with the present invention.
Figure 9:
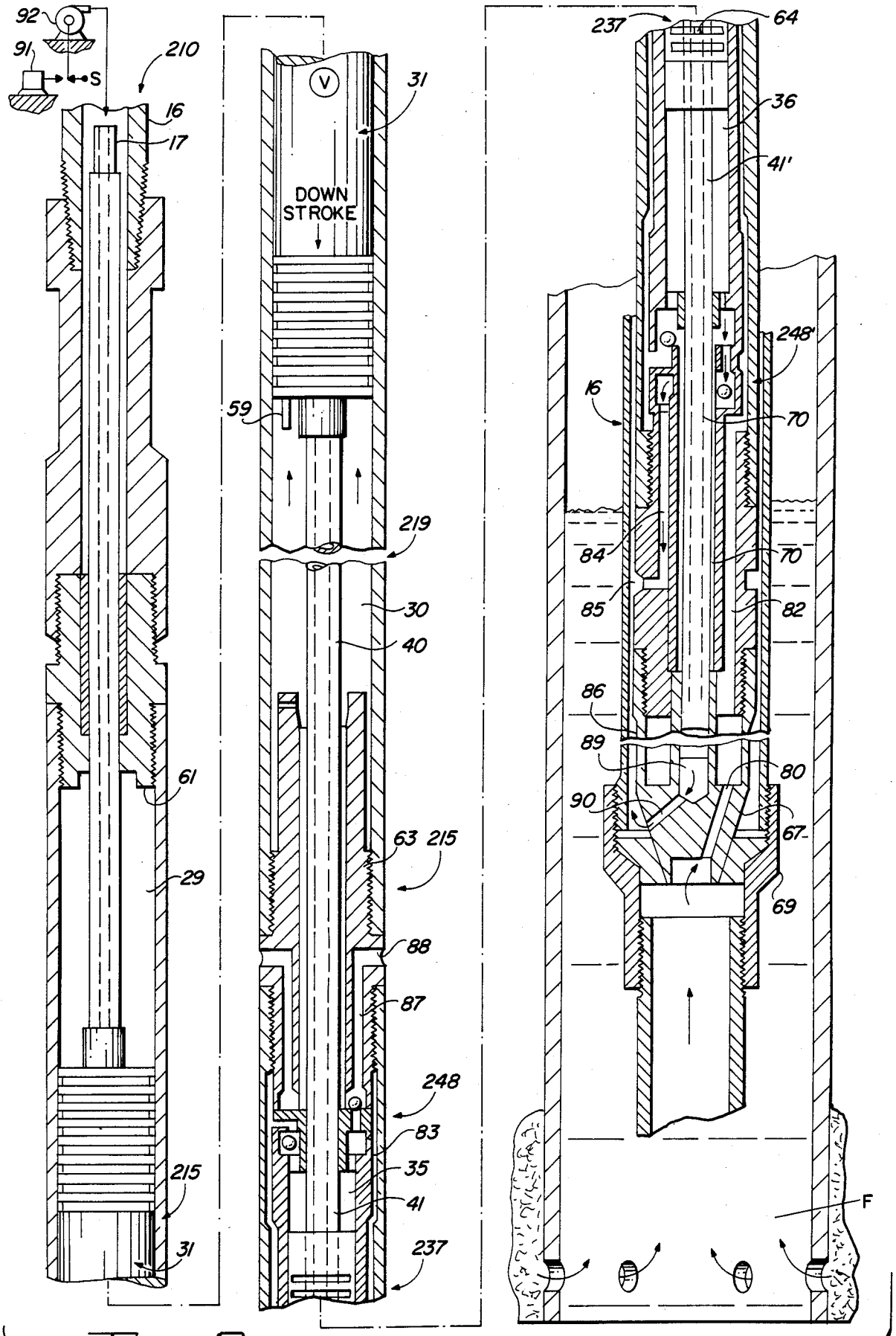
FIG. 9 is a longitudinal, part cross-sectional view of still another embodiment of the present invention.

In FIG. 6, there is disclosed a valve assembly for use in the embodiment of the invention seen disclosed in FIGS. 7 and 9. The valve assembly of FIG. 6 has a suction side connected to passageways 55 and 54. Formation fluid flows through the seat 48′ causing the ball 49′ to be unseated therefrom. Fluid continues into chamber 35 where the fluid is subsequently exhausted through radial ports 57, through the seat 48, which causes the ball 49 to be unseated therefrom, where the fluid then continues to flow up through the passageway 53 and through the produced fluid outlet port 21. The valve assembly set forth in FIG. 6 is for use in conjunction with the embodiment of FIGS. 7 and 9, while the valve assembly set forth in FIG. 5 is for use in conjunction with the embodiment of the invention disclosed in FIGS. 1–4.

In FIG. 7, engine piston 31 is provided with a pilot rod 59 which alternatingly abuttingly engages the opposed shoulders 60, 61 of the working chamber as the piston 31 reciprocates within chambers 29 and 30. The details of an engine having a piston 31 within which there is disposed a power oil control valve assembly is set forth in my co-pending patent application Ser. No. 416,996 now U.S. Pat. No. 4,477,234.

Lower engine chamber 30 of FIG. 7 is separated from the upper part of the spent power fluid discharge chamber 32 of the discharge tube 19 by a rod seal means 62. The lower part 33 of the discharge tube chamber is isolated from valve assembly 143 by a rod seal means 63. Additional details of the valve assembly 143 is set forth in FIG. 5 as well as in my previously issued U.S. Pat. No. 4,032,266.

Numeral 64 of FIG. 7 indicates a lubricating device for the production plunger 37. Spent power oil flows down the hollow connecting rod 40′ and into the radial passageways formed at 64. The radial passageways 64 extend from the interior of the hollow rod 41, laterally through the plunger 37, and thereby provides lubricant at the interface between the plunger 37 and the cylindrical wall of the pump end in a manner similar to the "oil ring" and an internal combustion motor. A working chamber 65 reciprocatingly receives the lower marginal free end of the lower connecting rod extension as indicated by numeral 42. The chamber 65 is formed by a sleeve which is closed at 66 and thereby forms a spent power fluid containing chamber which always communicates with chambers 32, 33, and the engine valve assembly and therefore is always filled with spent power fluid. The engine valve means alternately connects the interior of the connecting rod 40, 40′ to one of the engine chambers 29, 30; therefore chamber 65 always provides a continuous positive pressure of spent power fluid against the lower end 42 of the connecting rod 40′.

In FIG. 7, numeral 67 indicates the lower terminal end of the pump assembly. The lower end of the pump is seated within a shoe assembly 68, 69 which includes the illustrated lower borehole valve device. The shoe and valve device is advantageously employed in conjunction with a casing free type pump having a closed power fluid system. The details of the lower end of the pump and the shoe can take on several different forms, such as set forth in my previous U.S. Pat. No. 3,627,048, for example.

As an alternate embodiment of the invention, the closed chamber 65 provided by the housing 66 can be replaced with an open ended sleeve, and the passageway 70 of the connecting rod extension 41′ can be made relatively small so as to emit a small constant flow of spent power fluid into the formation fluid at formation fluid inlet 71. This novel method of operating a downhole hydraulically actuated pump enables treatment fluid to be admixed with power oil at the surface pump in a manner similar to FIG. 9, so that subsequent comingling of a small part of the spent power oil with the formation fluid at 71 treats the bottom of the wellbore, as well as all moving parts of the pump assembly. Various different treatment chemicals, including corrosion inhibitors, materials which solublize paraffin, and other known downhole treatment chemicals can advantageously be translocated from the surface of the earth down to the bottom of the wellbore in this new and novel manner.

Figure 8:
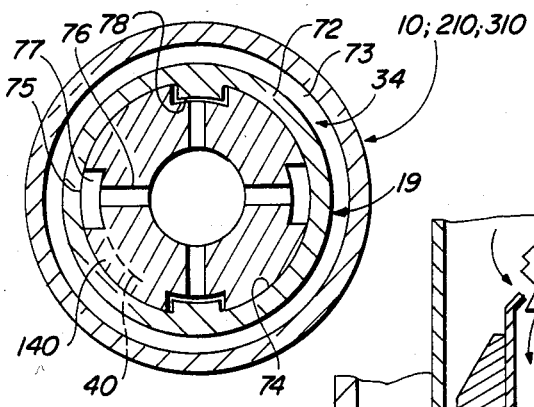
FIG. 8 is a cross-sectional view taken along line 8—8 of FIG. 7.

In FIGS. 7 and 8, and in particular FIG. 8, the discharge tube is illustrated together with the guide 34. The guide 34 is seen to be in the form of an enlarged, slotted, cylindrical guide means which effectively increases the diameter of a medial length of the connecting rod 40 to a diameter 140 so that it is slidably received in a non-rotatable manner in close tolerance relationship respective to the interior wall surface 74 of the guide housing 72. The wall surface 74 is provided with opposed male members 78 which capture the opposed female members 77 of the guide therewithin in a slidable manner.

In FIGS. 7 and 8, the plurality of longitudinal discharge ports 20 of the guide 34 communicate the radial ports 76 with the interior 58 of the connecting rod 40. The slots 77 slidably cooperate with the interior sidewall 74 to provide the illustrated radially spaced apart longitudinal passageways 75. The opposed passageways 75 communicate the upper and lower chambers 32, 33 with one another while radial ports 76 communicate the upper chamber 32 with the rod interior. Hence, spent power fluid flows from the engine valve, through the interior of the hollow connecting rod, through the ports 76 formed within the discharge guide, into the traveling passageway 77, and into the chamber 32, where the fluid is then free to flow through discharge port 20, into annulus 20′, and up the discharge tubing 28 to the surface. The guide 34 increases the structural integrity of the rod at a critical area which otherwise would be weakened by the presence of the outflow ports which must be formed in lieu of radial ports 76. The guide 34 maintains the alignment of the connecting rod 40, and enables the port size 76 to be significantly enlarged, thereby increasing the efficiency of the system. The discharge guide means of this invention therefore provides unexpected advantages when used in a downhole hydraulically actuated pump assembly.

FIG. 9 of the drawings illustrates still another embodiment of the present invention having a maximum size engine piston 31, within which there is mounted a power fluid valve assembly, such as set forth in the previous figures of the drawings. In the engine of the pump illustrated in FIG. 9, power fluid from power oil string 16 enters at the upper terminal end of the connection rod extension 17, flows through the rod interior and to the valve V of engine piston 31, where the power fluid is alternately conducted to one of the chambers 29 and 30, while spent power fluid is alternately exhausted from the other of chambers 30 and 29. The spent power fluid is discharged through the hollow connecting rod 40. The spent power fluid flows from the engine valve assembly, down through the hollow connecting rod 40, through production piston 237, down through the lower connection rod extension 41', and to a spent power fluid exhaust chamber 89. The spent power fluid then flows on through a port 90 located in the lower end of the pump assembly, and enters annular area 86 formed between the pump and tubing, where the spent power oil is admixed with produced fluid and flows to the surface of the ground.

Formation fluid F enters the bottom of the pump assembly of FIG. 9 through passageway 80, and flows to lower production valve 248' by means of passageway 82; and, continues on to production valve 248 by means of passageway 83. The longitudinal passageways 83 reduce the maximum possible pump plunger diameter that can be realized in a specific diameter pump barrel.

In FIG. 9, a suitable supply of treatment chemical, for example corrosion inhibitors, detergents, antifoam agents, and chemicals that solubilize paraffins are stored at 91 and transferred into the surface power oil pump 92. Power oil from S flows through pump 92, down the power oil tubing 16, and enters the end 17 of the hollow connecting rod extension, thereby providing the engine end of the pump assembly 210 with a source of power fluid, usually water or oil. Hence, the power oil, having treatment chemical admixed therewith, chemically treats the entire pump assembly as well as the entire wellbore, thereby eliminating many downhole problems that may otherwise be caused by material such as paraffin and gyp build-up, and keeps iron oxide suspended in solution.

A novel aspect of the embodiment of the invention of FIG. 9 is that the discharge spent power fluid prevents sand and other foreign matter from building up around the outside surface between the tubing and the pump main body at the lower end thereof since no fluid exhausts from inside the hollow rod directly into the production chamber, but instead the fluid exhausts into the lower annulus formed at the bottom of the pump. Accordingly, the downhole pump set forth in FIG. 9 provides a system wherein spent power fluid is discharged from the lower end of a larger, simple or multiple production pump, and provides a means by which a long, large engine and multiple production end pump can be made to fit in a relatively short cavity such as exists in most wellbores, thereby avoiding the high cost of pulling a short cavity from the wellbore and installing a longer pump receiving cavity in the borehole. Hence, this embodiment of the invention can be retrofitted within a number of prior art cavities at no additional expense, while gaining the above described results.

Figure 10:
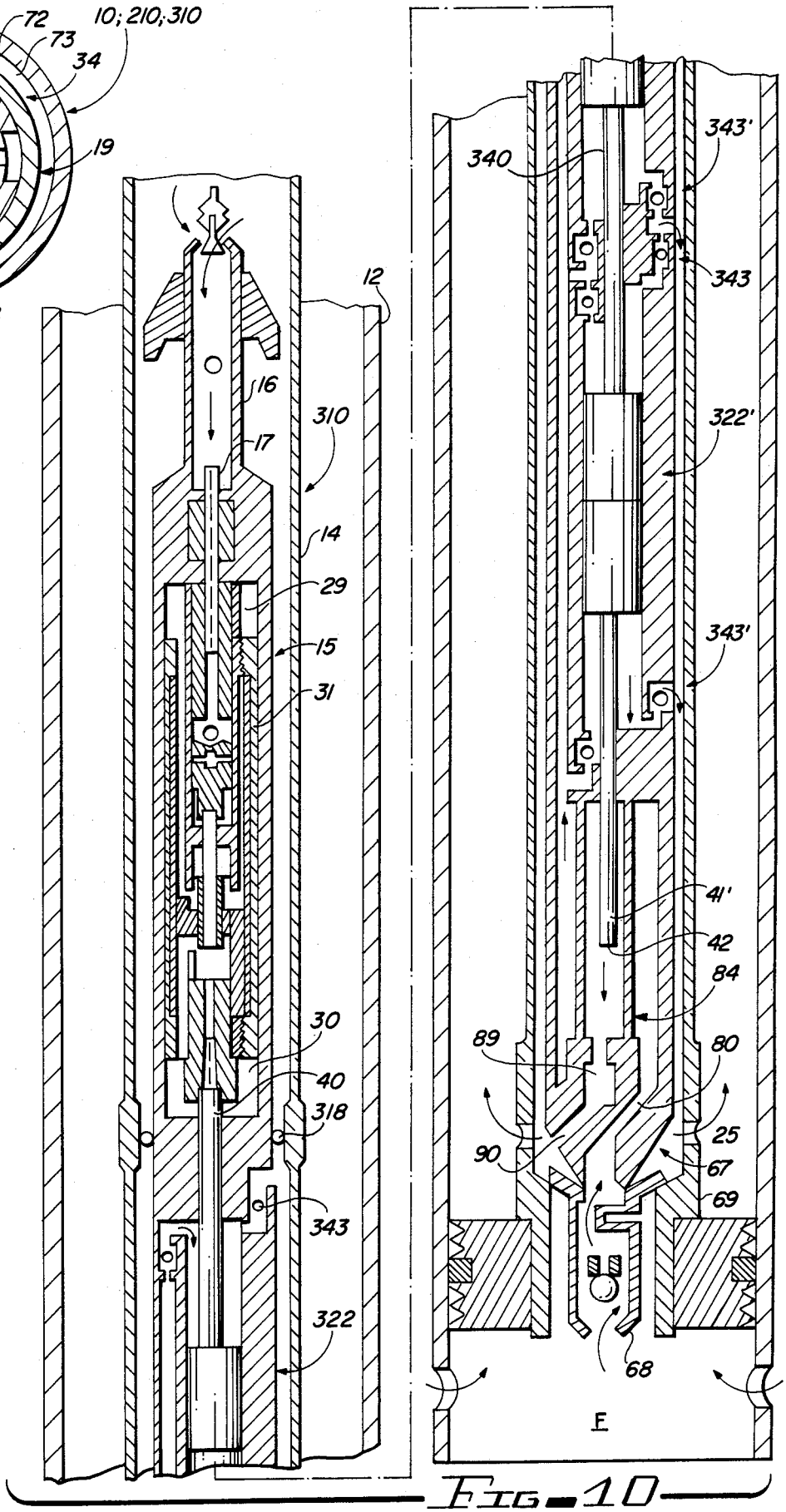
FIG. 10 is a longitudinal, part cross-sectional view of still another embodiment of the present invention.

FIG. 9 illustrates a fixed type pump having a single production piston, while FIG. 10 illustrates a free type pump assembly having multiple production plungers. In FIG. 10, the upper end 16 of the free pump assembly is illustrated with a packer and nose assembly attached thereto. Production valve assemblies 343 and 343' are of the type disclosed in FIG. 6, and are located above and below each of the production plungers 322 and 322'. Spent power fluid from the engine piston and valve assembly 15 is conducted down through the hollow connecting rod 40, through the upper production plunger 322, through the middle rod 340, through the lower production plunger 322', and through the lower rod extension 41' where the spent power fluid exhausts through the end 42 or the rod extension and into the illustrated discharge tube 84. The spent power fluid continues through passageways 89 and 90 formed in the lower end of the pump, exits into the tubing annulus, admixes with produced fluid, and flows to the surface. The produced fluid and spent power fluid flow through ports 25 located in the lower end of the tubing, and back up through the casing annulus, and to the surface of the ground.

FIGS. 11–14 illustrate one form of the invention by which the operation of the engine piston and valve assembly 31 can be carried out. Power oil is received through the upper connecting rod extension 17 and provides a continuous source of power fluid t the valve V, from which power fluid alternately flows into power chambers 29 and 30 (FIG. 10), while spent power fluid alternately is exhausted from power chambers 30 and 29 (FIG. 10). When the control rod 59 is moved into the illustrated position of FIG. 12 the engine control valve 93 is moved into the illustrated position of FIG. 12, the engine control valve 93 is moved into the illustrated position seen in FIGS. 11 and 12. This action causes power fluid to flow from the hollow rod extension 17, through port passageways 94, 94', 95, and 96, so that power fluid is effected in the lower power chamber 30. At the same time, spent power fluid flows from the upper power chamber 29, through ports 97, 98, and into passageway 99 and to the interior of connecting rod 40.

Figures 11, 12, 13, 14:
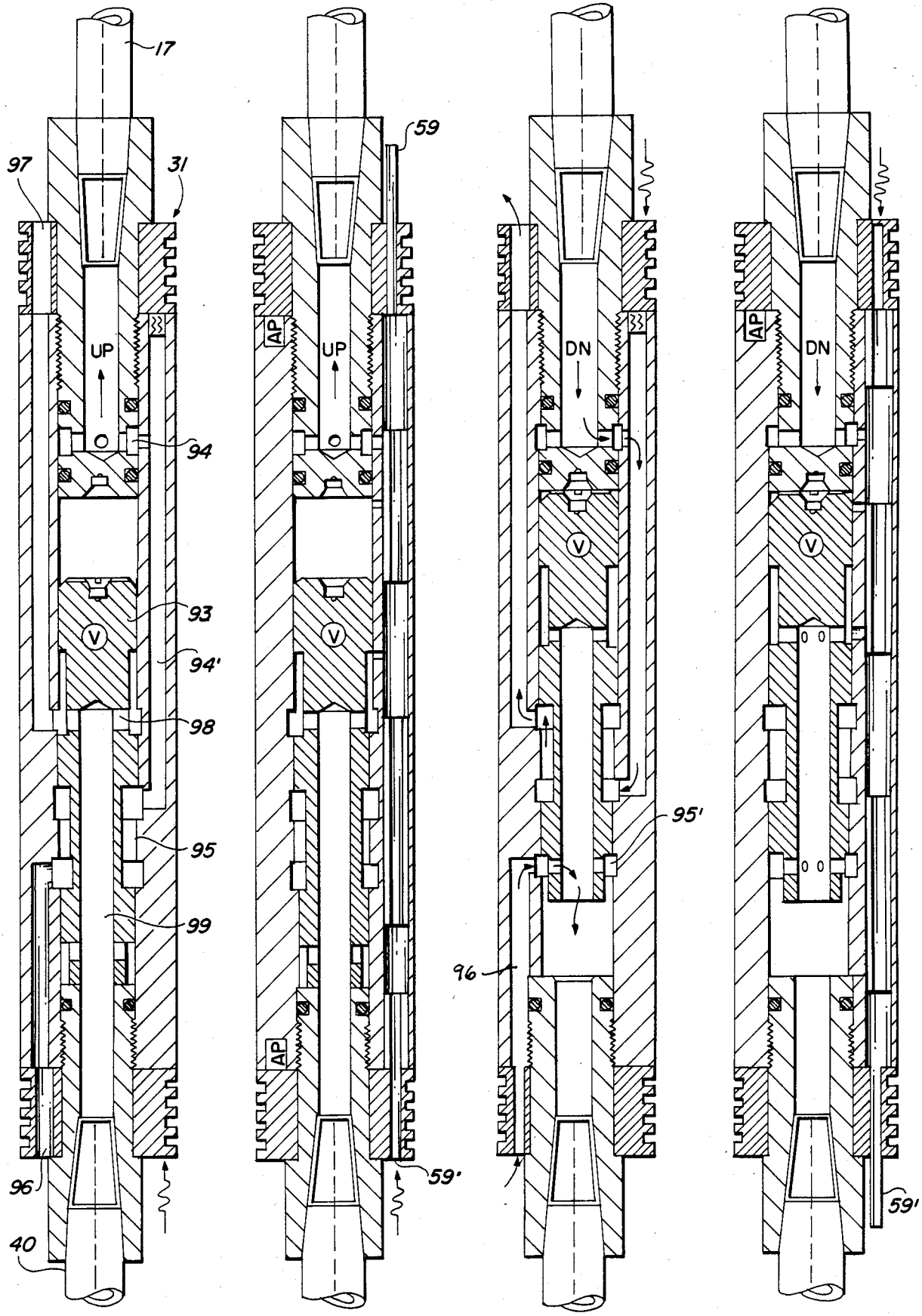
FIG. 11 is a fragmentary, longitudinal, cross-sectional view of part of an engine end of a pump made in accordance with this invention.
FIG. 12 is a longitudinal, cross-sectional view of the invention according to FIG. 11, but taken 90° along the same axis thereof.
FIG. 13 illustrates the pump of FIG. 11 in an alternate position of operation; and, FIG. 14 is a longitudinal, cross-sectional view of the present invention according to FIG. 11, but taken 90° along the same axis thereof.

FIGS. 13 and 14 illustrate the arrangement of the flow passageways of the engine piston and valve assembly when the piston is moving in a downward direction, wherein power fluid and spent power fluid now assume the alternate flow path, with power fluid flowing from the upper hollow rod extension, into passageway 94', through the passageway formed by the valve 93, up the passageway 97, and into the upper power chamber 29. At the same time, spent power fluid from chamber 30 is conducted through passageway 96, through the passageway 95' formed by the valve assembly 93, and into the hollow connecting rod 40, where the spent power fluid is ultimately exhausted from the pump assembly in one of the previously discussed manners.

In the embodiments of the invention illustrated in FIGS. 1–3, the engine piston and pump plunger have the maximum possible diameter respective to the outer diameter of the main housing and therefore there are no longitudinal flow passageways formed through the sidewall of the pump housing. In the claims, the term "maximum possible engine piston diameter" or "maximum possible pump plunger diameter" is intended to mean the absence or such flow passageways.

In operation of the embodiment set forth in FIGS. 1–5, both the engine end and the production end have been provided with the maximum possible diameter piston that can be made with respect to the specific diameter of the pump outer housing, which means that there can be no longitudinal flow passageways formed through the sidewall of the pump. The downhole pump illustrated in FIG. 1 can be of the fixed type, as seen in FIG. 2, having a closed power fluid system; or, a free type as seen illustrated in FIG. 3. The free type pump of FIG. 3 can be provided with a packer and nose assembly, such as seen illustrated in FIG. 10, and as set forth in my previously mentioned patents, for example.

In the embodiment of the invention disclosed in FIGS. 1–3, power fluid flows down through the hollow rod extension, to the valve assembly located within the engine piston, where the power fluid is diverted into one of the opposed power chambers, while spent power fluid is returned from the other of the two power chambers, through the engine valve, and is exhausted from the pump assembly. More specifically, the returned spent power fluid flows from the engine valve assembly, into the hollow connecting rod, through the discharge guide, and into the guide chamber 32, where the spent power fluid is then exhausted through port 20.

Formation fluid is received within the inlet formed at the lower end of the pump assembly, flows up through the lower hollow rod extension, and to the traveling valve which is housed or supported within the production plunger. The production valve assembly contained within the production plunger controls the flow of formation fluid into the production chambers 35 and 36. The engine piston causes the production plunger to reciprocate, whereupon the produced fluid is forced from the production end of the pump assembly and through the upper and lower valves 43 and 43'. The valves 43 and 43' are made in accordance with the embodiment of the invention set forth in FIG. 5 of the drawings. The details of the production plunger and the traveling valve supported therewithin are set forth in FIG. 4 of the drawings.

Hence, the pump of the present invention is provided with an engine piston connected to a pump plunger by means of a connecting rod. The connecting rod has opposed extensions depending from the engine piston and pump plunger. An internal flow path is formed through the connecting rod and extensions which provide power fluid to the engine end, formation fluid to the pump end, and a means by which spent power fluid is exhausted from the engine end.

In the embodiment of the invention seen disclosed in FIG. 7, the engine end has the largest diameter piston possible for a specific size engine housing. Spent power fluid is exhausted from the engine end by means of the before discussed traveling guide means, the details of which are more fully set forth in FIG. 8. The exhausted spent power fluid is returned by means of the guide assembly to the surface of the earth, and is maintained in a closed system. Marginal lengths of the connecting rod string including the upper extension, connecting rod, and lower rod extension is made into a fluid conduit so that power fluid is received at the engine by flowing power fluid through the upper rod extension, while the spent power fluid exerts a pressure which is effected on the bottom end of the connecting rod by means of the rod interior flow passageway.

Formation fluid flows into the lower end of the pump and to the pump working chambers by means of the illustrated production valves, which are made in accordance with FIG. 6 of the drawings. The production piston is lubricated by the spent power fluid.

The embodiment of the invention disclosed in FIG. 2 sets forth a closed system, FIG. 9 can be of the free type as seen in FIG. 10; or, of the fixed type as seen illustrated in FIG. 9. The embodiment of the invention seen in FIG. 9 can be provided with multiple pistons, such as seen illustrated in FIG. 10, for example while remaining within the comprehension of this invention.

FIGS. 11–14 illustrate the operation of the engine end of the pump assembly previously disclosed in the other figures of the drawings. The operation of the engine is more fully described in my before mentioned patent.

The present invention finds maximum utility where a downhole pump requires the maximum size engine end piston, and maximum size production end piston. The discharge guide means of the present invention provides a novel means by which spent power fluid can be exhausted from a downhole pump engine and is considered a sub-combination of this invention. The present invention further provides a new method by which the entire pump and wellbore can be chemically treated, thereby greatly enhancing the operational life of the pump and well in an unexpected manner.

I claim:

1. In a downhole pump of the type having a main housing within which there is formed an engine chamber and a production chamber, a piston reciprocatingly received within the engine chamber, a plunger reciprocatingly received within the production chamber, a connecting rod by which the piston and plunger are connected together; the combination with said main housing, piston, plunger, and connecting rod of a discharge guide assembly by which spent power fluid discharged from the engine is conducted away from the pump assembly;

said discharge guide assembly includes a discharge chamber concentrically arranged about said connecting rod and forming an annulus thereabout;

a guide means affixed to said connecting rod to be moved therewith; said guide means is reciprocatingly received within said discharge chamber;

means forming a flow path which extends from said piston, through said connecting rod, through said guide means, and into said discharge chamber;

said guide means divides said discharge chamber into an upper and lower discharge chamber, means forming a flow path from said lower discharge chamber, through said discharge guide, and to said upper discharge chamber; and, means forming a discharge port by which spent power fluid can flow from said discharge chamber, through said main body, and away from said pump assembly.

2. The combination of claim 1 wherein said discharge guide and said discharge chamber include means thereon by which the discharge guide is non-rotatable respective to the discharge chamber.

3. The combination of claim 2 wherein said means rendering the guide and chamber non-rotatable respective to one another is a longitudinal groove formed in the guide, said discharge chamber having a longitudinally extending member received within the groove in a slidable manner.

4. The combination of claim 3 wehrein the upper and lower discharge passageways are flow connected by one said longitudinal groove.

5. The combination of claim 1 wherein said guide means is made integral respective to said rod to thereby increase the structural integrity of the rod.

6. A hydraulically actuated pump assembly for producing fluid from a formation located downhole in a borehole, said pump assembly has a main body, a power piston, a pump plunger, a connecting rod by which said plunger is affixed to said power piston;

said main body forms a power chamber and a production chamber, said power piston and pump plunger, respectively, are reciprocatingly arranged in slidable sealed relationship within said power chamber and production chamber, respectively;

a traveling engine valve assembly mounted within said power piston for controlling flow of power fluid to and spent power fluid from the power piston; a traveling production intake valve assembly mounted within said pump plunger for controlling the flow of formation fluid to the plunger;

an upper connecting rod extension which extends from said power piston, through the power chamber, and to a source of power fluid; means forming a flow passageway from the power fluid source, through the connecting rod extension, and to the engine valve assembly;

a discharge guide means is located within said main body at a location between said power chamber and said production chamber, said discharge guide means includes a medial length of said connecting rod which is enlarged in diameter and reciprocatingly received within a discharge guide chamber; passageway means leading from the engine valve assembly to the interior of the connecting rod, through the enlarged diameter part of the connecting rod, into the guide chamber, and through the main body through which spent power fluid can be exhausted;

a lower connecting rod extension which extends from said plunger, through said production chamber, and to a source of formation fluid; means forming a flow passageway from the formation fluid source, through the lower connecting rod extension, and to the production intake valve assembly; a production outlet valve means connected to control flow of produced fluid from the productiCon chamber; so that, reciprocation of the plunger causes formation fluid to be produced by the pump assembly;

means for shifting said engine valve assembly into one alternate position when said piston upstrokes and thereby flow power fluid into the upper power chamber while spent power fluid is exhausted from the lower power chamber; and, means for shifting said engine valve assembly into another alternate position when said piston downstrokes and thereby flows power fluid into the lower power chamber while spent power fluid is exhausted from the upper power chamber; whereby, power fluid is applied to alternate sides of said power piston to cause the power piston and plunger to stroke while spent power fluid and produced fluid are exhausted from the pump assembly.

7. The pump assembly of claim 6 wherein said passageway means includes the enlarged diameter part of the connecting rod which is provided with a longitudinal external groove arranged parallel to the longitudinal axis of the connecting rod, said groove has opposed ends which communicate with the guide chamber, said passageway means includes a flow passageway which communicates the groove with the hollow rod.

8. The pump assembly of claim 7 wherein an outlet production valve means is mounted at opposed ends of said production chamber through which produced fluid flows.

9. The pump assembly of claim 6 wherein an outlet production valve means is mounted at opposed ends of said production chamber through which produced fluid flows.

10. The pump assembly of claim 6 wherein said main body has a maximum diameter power chamber formed therein, the power chamber sidewalls being uninterrupted by flow passageways and the like.

11. In a downhole hydraulically actuated pump assembly of the type having a main body within which there is formed an engine chamber and a production chamber; an engine piston reciprocatingly received within the engine chamber and dividing the engine chamber into upper and lower power chambers;

a pump plunger reciprocatingly received within the production chamber and dividing the production chamber into upper and lower chambers; a connecting rod connecting the plunger to the engine piston, intake valve means by which formation fluid can flow into said production chamber, outlet valves means by which produced fluid can flow from said production chamber;

a connecting rod extension aligned longitudinally respective to said engine piston and connected to a power fluid source; a control valve means located within said engine piston, said control valve means reciprocates between two alternate positions in response to the location of the engine piston; said control valve means controls the flow of power fluid from said connecting rod extension to alternate upper and lower engine chambers, and controls the flow of spent power fluid from alternate lower and upper engine chambers;

a discharge guide means is located within said main body at a location between said engine chamber and said production chamber, said discharge guide means includes a medial length of said connecting rod which is enlarged in diameter and reciprocatingly received within a discharge guide chamber; passageway means leading from the interior of the connecting rod, through the enlarged diameter part of the connecting rod, into the guide chamber, and through the main body through which spent power fluid can be exhausted;

means forming a first flow path which extends through said connecting rod extension, through said control valve means, and into one of the power chambers whereby power fluid effected within said connecting rod forces said engine piston to stroke when said control valve means is in one of the alternate positions; means forming a spent power fluid flow path which extends from the other said power chamber into said piston, through said control valve means, into said connecting rod, and to said discharge guide means so that power fluid can be exhausted from the other power chamber when said control valve means is in one of the alternate positions;

whereby power fluid forces said piston to stroke uphole and thereafter forces said piston to stroke downhole, thereby reciprocating said plunger and causing formation fluid to flow through said production chamber in response to reciprocal action of said pump plunger.

12. A hydraulically actuated pump assembly for producing fluid from a formation located downhole in a borehole, said pump assembly has a main body, a power piston, a pump plunger a connecting rod by which said plunger is affixed to said power piston;

said main body forms a power chamber and a production chamber, said power piston and pump plunger, respectively, are reciprocatingly arranged in slidable sealed relationship within said power chamber and production chamber, respectively;

a traveling engine valve assembly mounted within said power piston for controlling flow of power fluid to and spent power fluid from the power piston; a traveling production intake valve assembly mounted within said pump plunger for controlling the flow of formation fluid to the production chamber;

an upper connecting rod extension which extends from said power piston, through the power chamber, and to a source of power fluid; means forming a flow passageway from the power fluid source, through the connecting rod extension, to the engine valve assembly, and into the power chamber;

a lower connecting rod extension which extends from said plunger, through said production chamber, and to a source of formation fluid; means forming a flow passageway from the formation fluid source, through the lower connecting rod extension, to the production intake valve assembly, and into the production chamber;

a production outlet valve means connected to control flow of produced fluid from the production chamber, and away from the pump assembly;

means for shifting said engine valve assembly into one alternate position when said piston upstrokes and means for shifting said engine valve assembly into another alternate position when said piston downstrokes; whereby, power fluid is applied to said piston to cause the piston and plunger to upstroke, and thereafter, the spent power fluid is exhausted from the pump assembly on the downstroke;

means forming a discharge guide assembly between said power and production chambers; said discharge guide assembly includes a discharge guide chamber and a guide means;

said discharge guide chamber is a continuation of said main body, said guide means is a medial length of said connecting rod;

means forming a spent power fluid flow passageway from said engine valve assembly, through said connecting rod, through said guide means, into said guide chamber, through said main body, and away from said pump assembly.

13. The pump assembly of claim 12 wherein said power chamber and said production chamber have a circumferentially extending sidewall of continuous solid annular construction with no longitudinal passageways formed therethrough so that the inside diameter of the power and production chambers are of a maximum possible size to thereby provide a power and production piston of maximum diameter.

14. The pump assembly of claim 13 wherein said engine valve assembly is shifted between alternate positions by a control rod which extends longitudinally through the power piston to provide opposed control rod ends, the upper end of the control rod abuttingly engages the upper end of the power chamber while the lower end of the control rod abuttingly engages the lower end of the power chamber so that the control rod is shifted down respective to the power piston when the piston upstrokes, and the control rod is shifted up respective to the power piston when the piston downstrokes.

15. In a downhole hydraulically actuated pump assembly having an engine end and a pump end, a source of power fluid connected to the upper end thereof; a source of formation fluid connected to the lower end thereof, and means for conducting produced fluid and spent power fluid from the pump assembly, uphole to the surface of the ground; said pump assembly including an engine piston dividing the engine end into upper and lower engine chambers; a pump plunger, said piston is connected to said pump plunger by a hollow connecting rod; said plunger divides the pump end into upper and lower pump chambers; a traveling engine valve enclosed within said piston for controlling power fluid flow to and spent power fluid flow from the piston; a traveling production valve enclosed within said plunger for controlling the flow of formation fluid to the plunger, the improvement comprising:

said connecting rod having an upper and a lower rod extension, respectively, which extends through the upper engine chamber and lower pump chamber, respectively;

a discharge guide means is located within said main body at a location between said engine and said pump end, said discharge guide means includes a medial length of said connecting rod which is enlarged in diameter and reciprocatingly received within a discharge guide chamber; passageway means leading from the interior of the connecting rod, through the enlarged diameter part of the connecting rod, into the guide chamber, and through the main body through which spent power fluid can be exhausted;

means forming a power fluid flow path extending from the upper end of the pump assembly, through the upper rod extension, the engine valve means, and to one of the upper and lower engine chambers; a spent power fluid flow path extending from the other of the upper and lower engine chambers, to the engine valve means, into the hollow connecting rod, through said discharge guide means, and out of the pump assembly;

and means forming a flow path from the lower end of the pump assembly, into the lower rod extension, into the plunger, to the production valve, and into one of the pump chambers; valve means for controlling produced fluid flow from the upper and lower pump chambers and out of the pump assembly;

and means for shifting the engine valve means to cause power fluid to alternately flow into the upper and then the lower engine chamber, while spent power fluid alternately flows from the lower and then from the upper engine chambers.

16. The pump assembly of claim 15 wherein the enlarged diameter part of the connecting rod is provided with a longitudinal external groove arranged parallel to the longitudinal axis of the connecting rod, said groove has opposed ends which communicate with the guide chamber, said passageway means include a flow passageway which communicates the groove with the interior of the hollow rod.

17. The pump assembly of claim 15 wherein the power chamber sidewalls are uninterrupted by flow passageways and the like to thereby enable said main body to have a maximum diameter power chamber formed therein.

* * * * *

UNITED STATES PATENT AND TRADEMARK OFFICE

CERTIFICATE OF CORRECTION

PATENT NO. : 4,664,186

DATED : May 12, 1987

INVENTOR(S) : GEORGE K. ROEDER

It is certified that error appears in the above-identified patent and that said Letters Patent is hereby corrected as shown below:

In the title substitute --DOWNHOLE-- for "DOWNHOLD";

Column 1, line 1, in the title substitute --DOWNHOLE-- for "DOWNHOLD";

Column 3, line 58, substitute --fluid-- for "flui";

Column 8, line 9, substitute --to-- for "t";

Line 46, substitute --of-- for "or";

Column 11, line 23, correct the spelling of "production";

Column 14, line 27, insert --to-- after "extension,";

Line 52, substitute --includes-- for "include".

Signed and Sealed this

Seventeenth Day of November, 1987

*Attest:*

DONALD J. QUIGG

*Attesting Officer*

*Commissioner of Patents and Trademarks*